US006240594B1

(12) United States Patent
Demai et al.

(10) Patent No.: US 6,240,594 B1
(45) Date of Patent: Jun. 5, 2001

(54) BRUSHING IMPLEMENT COMBINING BROOM, DUSTPAN AND REFUSE CAN

(76) Inventors: Jean-Claude Demai, 3, Rue d'Italie, 06000 Nice; Michele Eberard, 12, Rue de la Paix, 13100 Aix en Provence, both of (FR)

( * ) Notice: Subject to any disclaimer, the term of this patent is extended or adjusted under 35 U.S.C. 154(b) by 0 days.

(21) Appl. No.: 09/367,924

(22) PCT Filed: Mar. 20, 1998

(86) PCT No.: PCT/FR98/00570

§ 371 Date: Aug. 20, 1999

§ 102(e) Date: Aug. 20, 1999

(87) PCT Pub. No.: WO98/42247

PCT Pub. Date: Oct. 1, 1998

(30) Foreign Application Priority Data

Mar. 21, 1997 (FR) ..... 97 03729

(51) Int. Cl.[7] ..... A47L 13/52

(52) U.S. Cl. ..... 15/257.2; 15/257.1; D32/74

(58) Field of Search ..... 15/257.1, 257.2, 15/257.3, 257.4, 257.6, 257.7; D32/74

(56) References Cited

U.S. PATENT DOCUMENTS

| | | | | |
|---|---|---|---|---|
| 132,367 | * | 10/1872 | Musgrove | 15/257.2 |
| 202,357 | * | 4/1878 | Mann | 15/257.2 |
| D. 383,002 | * | 9/1997 | Rigney | D32/74 |
| 675,052 | * | 5/1901 | Carlson | 16/257.2 |
| 783,657 | * | 2/1905 | Walter | 15/257.2 |
| 926,927 | * | 7/1909 | Devol | 15/227.2 |
| 3,170,183 | * | 2/1965 | Leatherman | 15/257.2 |
| 4,050,110 | * | 9/1977 | Donnelly | 15/257.2 |
| 5,379,481 | | 1/1995 | Demarks . | |
| 5,826,297 | * | 10/1998 | Footer et al. | 15/257.2 |
| 5,924,162 | * | 7/1999 | Kalscheur et al. | 15/157.2 |
| 6,052,860 | * | 4/2000 | Coxsey | 15/257.2 |

FOREIGN PATENT DOCUMENTS

| | | |
|---|---|---|
| 2410806 | 9/1975 | (DE) . |
| 9112801 | 12/1991 | (DE) . |
| 731374A | 9/1932 | (FR) . |
| 2594902 | 8/1987 | (FR) . |
| 2609312 | 7/1988 | (FR) . |

* cited by examiner

*Primary Examiner*—Terrence R. Till
(74) *Attorney, Agent, or Firm*—Ladas and Parry

(57) ABSTRACT

The invention concerns an implement comprising a removable dustpan (3) and a refuse can (2), fixed on a broom handle (1) wherein the refuse can (2) is detachably mounted at a predetermined height above the broom brush (4).

9 Claims, 4 Drawing Sheets

BRUSHING IMPLEMENT COMBINING BROOM, DUSTPAN AND REFUSE CAN

FIELD OF THE INVENTION

The present invention relates to an implement comprising a broom, a refuse can and a dustpan. The refuse can and dustpan are fixed to the handle of the broom, so as to connect these three elements together into one sole implement.

BACKGROUND OF THE INVENTION

For centuries, floors have been swept with the aid of a broom constituted by a handle and a brush, a dustpan and a refuse can. The function of the broom is to collect together the dust intended to be picked up in the dustpan, so the dust can be thrown in the refuse can. These three elements: the broom, dustpan and refuse can, are independent implements, which are gathered together in order for sweeping to be effective. It is therefore necessary for the operator to effect two manipulations—(1) to gather together the broom, the dustpan and the refuse can, and (2) to take them to the place to be swept. The obvious consequence is a loss of time and efficiency, as these implements are generally not kept in the same place. Furthermore, when sweeping stairs, the presence of a refuse can or of a dustpan placed on the floor might cause the operator to trip.

It should be emphasized that the operator often works in places which are poorly illuminated, such as cellars, underground car parks, tradesmen's staircases and that his/her safety, and that of possible passers-by, particularly elderly people, are jeopardized by the dustpans and refuse cans placed on the floor. Moreover, the refuse cans and the dustpans can be easily knocked over, which may require additional sweeping. These drawbacks are such that certain operators are obliged to carry out their cleaning chores by fixing a refuse bag on their belt, which is particularly unhygienic and dangerous.

Furthermore, the operator needs to move the dustpan and refuse can constantly, which requires of him/her efforts of which the accomplishment procures no noteworthy improvement in the quality or efficiency of the sweeping.

Two types of devices are known which tend, on the one hand, to reduce these efforts and displacements of the operator to recover and bring the refuse can to the place where he/she has collected together the refuse thanks to the broom in order precisely to transfer it into the refuse can, and, on the other hand, to avoid the risks of someone tripping over the dustpan and refuse can placed on the floor during the sweeping operation:

DE 9112801 discloses a broom comprising a handle and a brush combined with a bucket fixed on the handle of the broom and a removable dustpan likewise attached to this handle whose bottom partially covers the bucket. The principal object of DE 9112801 is to avoid unnecessary displacements for the sweeper by fixing the bucket acting as recipient in a non-removable manner on the handle of the broom so that it rests on the upper part of the brush. Thus, even if the sweeper is negligent or absent-minded, he can never forget the bucket at a place different from the one where he is and where he will have piled up the refuse. To prevent the operator from separating the bucket from the broom, the handle of the broom passes through one of the walls of the bucket, which makes it necessary to have a second small brush to pick up the refuse and transfer it to the bucket. This hinders the sweeper in his movements.

FR 731 374 and U.S. Pat. No. 5,379,481 disclose boxes adapted to contain the sweepings picked up by a broom.

These boxes comprise either an opening door, or an articulation to render them pivoting or both. Each box is fixed at the end of a handle in order to avoid bending down during refuse collection. The broom is hooked on said handle and/or fitted in the box once tipped back into vertical position for transport. These devices reduce the efforts of the operator who no longer needs to bend down, but he must separate the box from the handle of the broom during the sweeping operation, which either immobilizes one of the operator's hands if the operator does not want to put it down, which limits sweeping efficiency, or necessitates placing said box at a spot distinct from the place of sweeping.

SUMMARY OF THE INVENTION

Thus, in order in particular to overcome the drawbacks of these known implements, and to satisfy inter alia the same purpose, namely to provide an implement combining all the elements necessary for sweeping wherein the elements remain assembled during the sweeping, the implement according to the invention, comprises a removable dustpan and a refuse can fixed on a broom handle. The refuse can is provided with reversible fixing means, which allows the refuse can to be removed from the handle and also to lock said refuse can at any determined height above the brush of the broom to be used with said dustpan.

Once the sweeping operation is finished and the refuse has been collected with the aid of the broom, the operator, while remaining in the same spot, then removes the dustpan from the broom handle and places it on the floor in order to push the refuse therein with the same broom. The operator then just has to tip said dustpan into the box acting as refuse can which is fixed on the broom handle. The refuse can may then be emptied by any means as described hereinafter or dismantled form the handle since it is fixed thereto by any reversible fixing means.

According to a first embodiment of the invention, the fixing means with which the refuse can and/or the dustpan are provided, are clips. According to other embodiments of the invention, the means are collars or rings or any device with screws associated therewith.

Advantageously, the refuse can has a capacity of one to five liters and may even be limited to two liters [liters], in order to be compact enough and to facilitate manipulation of the broom, such as a broom of rectangular cross-section of which the largest length arranged against the broom handle must be substantially greater than the width of the dustpan in order easily to transfer the refuse therein. On the other hand, this largest dimension of broom opening of the refuse can is preferably smaller than the width of the broom, the broom having to be able to be efficient for sweeping large surfaces contrary to those used in the so-called "airport dustpan" devices, as described in U.S. Pat. No. 5,379,481 mentioned above.

The refuse can may also comprise means for evacuating its contents, such as in particular a door, a slideway, a valve or any other system of evacuation known which does not require that the refuse be separated from the handle in order to empty it.

According to a preferred embodiment of the invention, the refuse can contains tongues capable of reversibly locking a dustpan. Similarly the tongues may comprise notches which reversibly retain it on the refuse can. The dustpan may also be fixed directly on the handle independent of the refuse can, for example, according to the embodiments described in Patents FR 2 594 902 and FR 2 609 312.

According to another preferred embodiment, the refuse can may be composed of a box possibly provided with a lid and a belt or any other intermediate means for supporting this box. The supporting means is reversibly fixed on the handle at any determined height such that the broom may be used without hindrance despite the presence of said refuse can. The supporting means is adapted to maintain the box of the refuse can vertical with the handle, said refuse can being easily removable from this support; in which case, said refuse can does not need to have means for evacuating its contents since it may be separated from its support in order to be emptied or replaced.

Said refuse can may also be a tipping box of the "so-called airport dustpans" type as described in U.S. Pat. No. 5,379,481. The handle may be of any variable length compatible with that of the broom itself. If the handle is shorter, the operator avoids having to bend down to the floor to pick up the refuse as in the case of a traditional dustpan such as the one shown in the accompanying Figures. The handle may then be directly fixed in reversible manner on that of the broom, said refuse can then acting as a dustpan and being disposed in accordance with the present invention.

According to, another preferred embodiment of the invention, the implement of the present invention is used for household or industrial purposes for sweeping floors and/or stairs.

The invention will be more readily understood on reading the detailed description which follows and which refers to the accompanying Figures which illustrate the invention in a non-limiting manner since they show only a particular embodiment which has no limiting character. Other embodiments are possible within the framework of the scope and extent of this invention in particular by changing the shape of the refuse can and the dustpan, the latter being able to be replaced for example as indicated hereinabove by a single tipping box assembly of the "airport dustpan" type.

BRIEF DESCRIPTION OF THE SEVERAL VIEWS OF THE DRAWING(S)

DETAILED DESCRIPTION OF THE INVENTION

Figure 1:
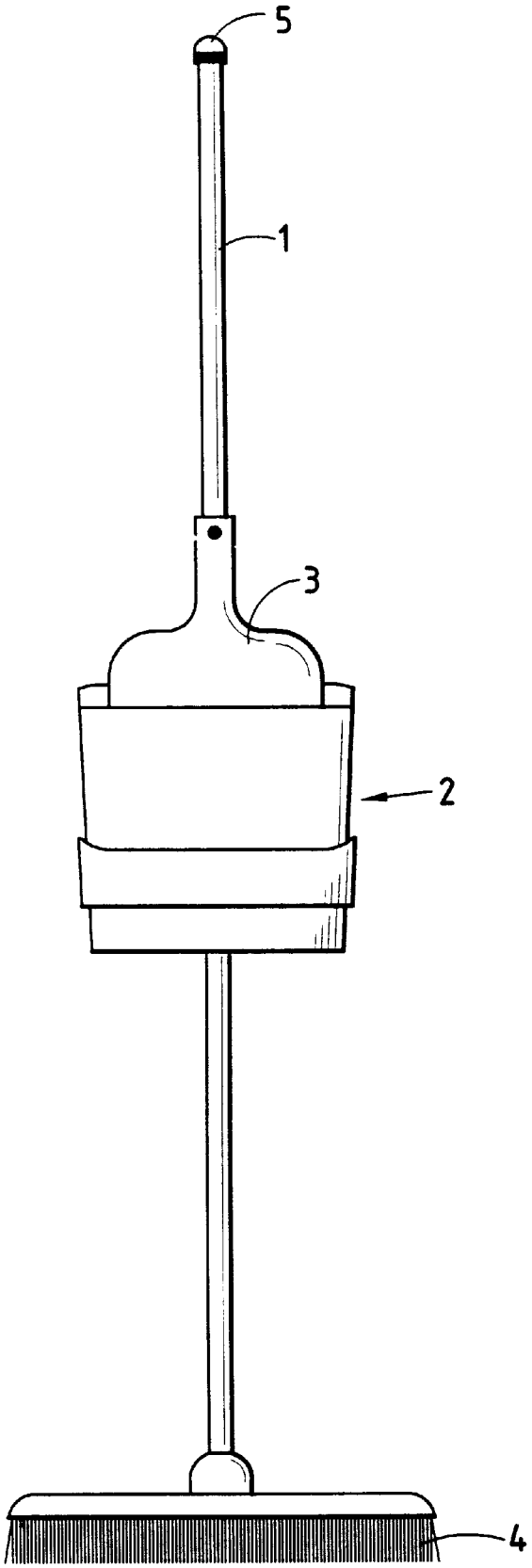
FIG. 1 is a schematic front view of an embodiment of the implement according to the invention.
Figure 2:
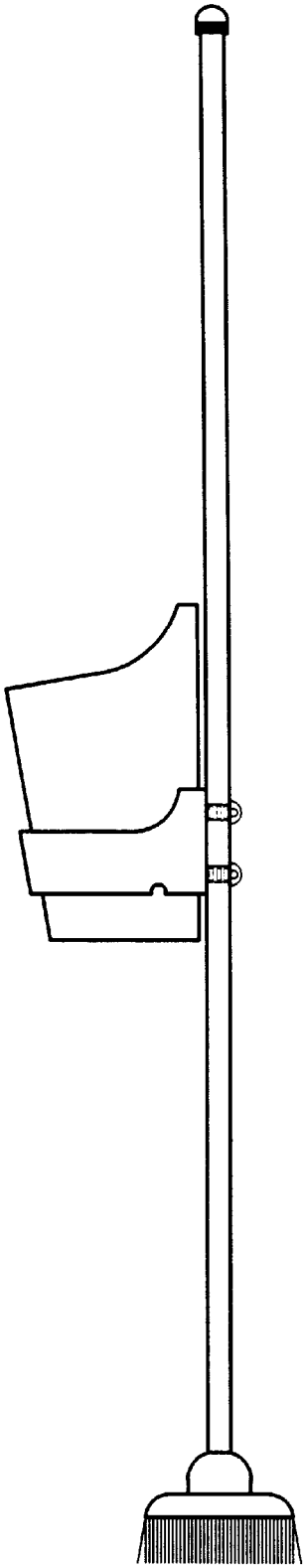
FIG. 2 is a side view of the implement shown in FIG. 1 but without its dustpan.
Figure 3:
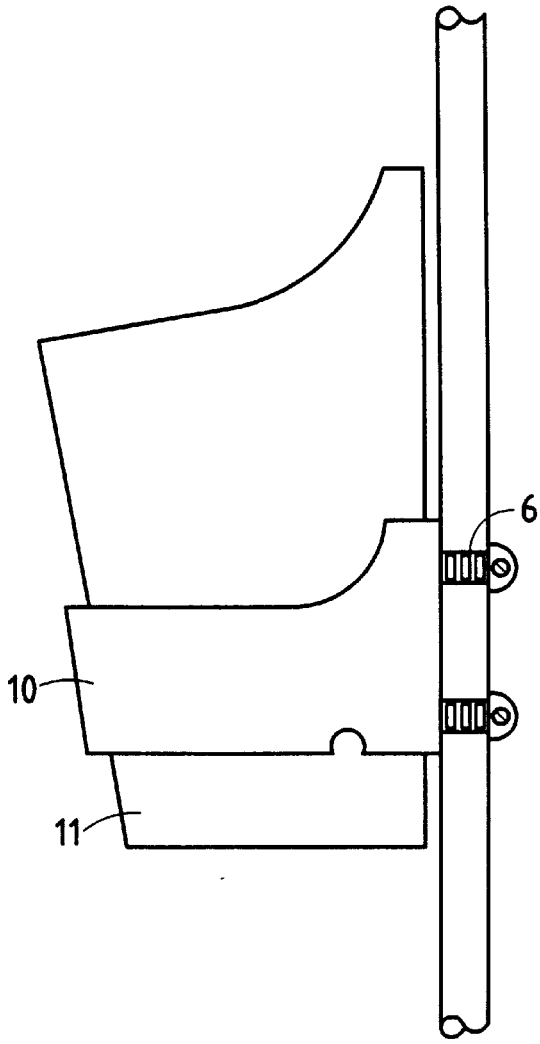
FIG. 3 is a closer view in profile of the refuse can shown in FIG. 2 fixed in a removable manner and combined with an intermediate fixing support reversibly mounted on the handle of the implement.
Figure 5:
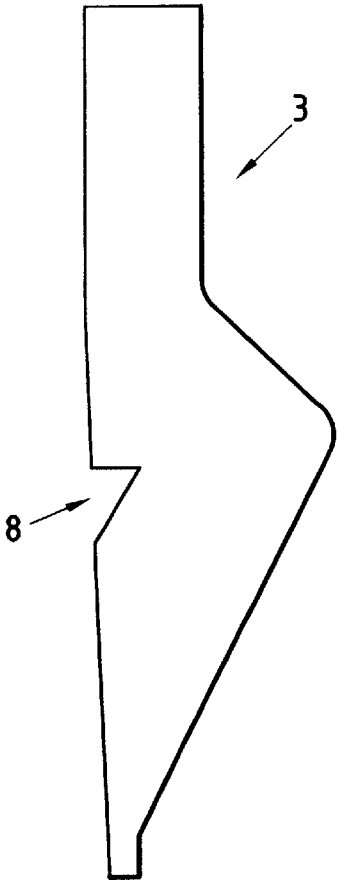
FIG. 5 shows a side view of the dustpan of FIG. 4.
Figure 4:
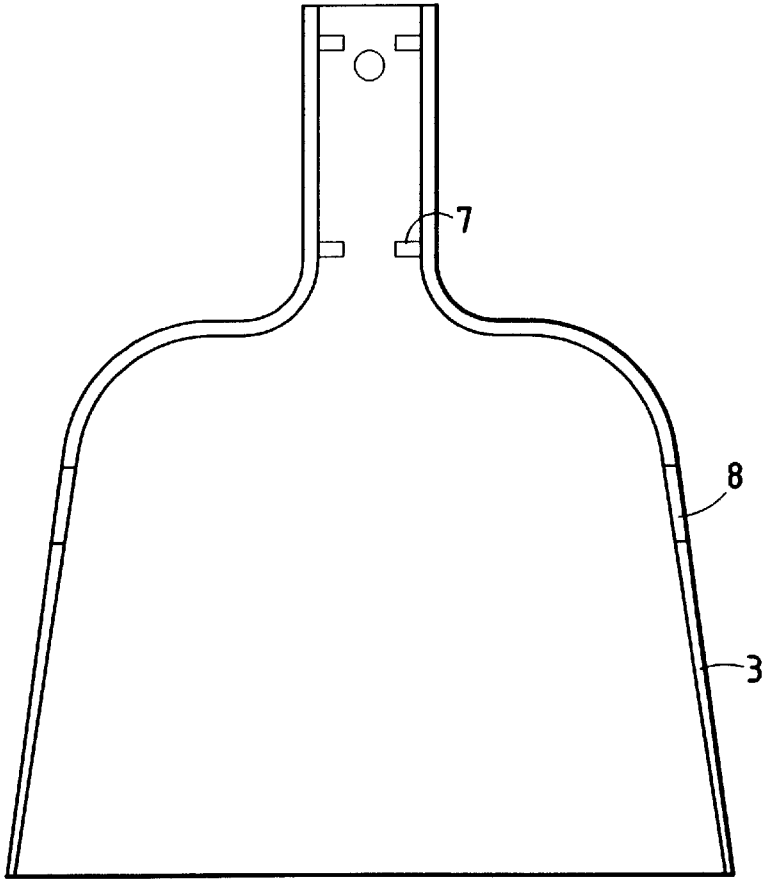
FIG. 4 shows a front view of an example of a dustpan.
Figure 6:
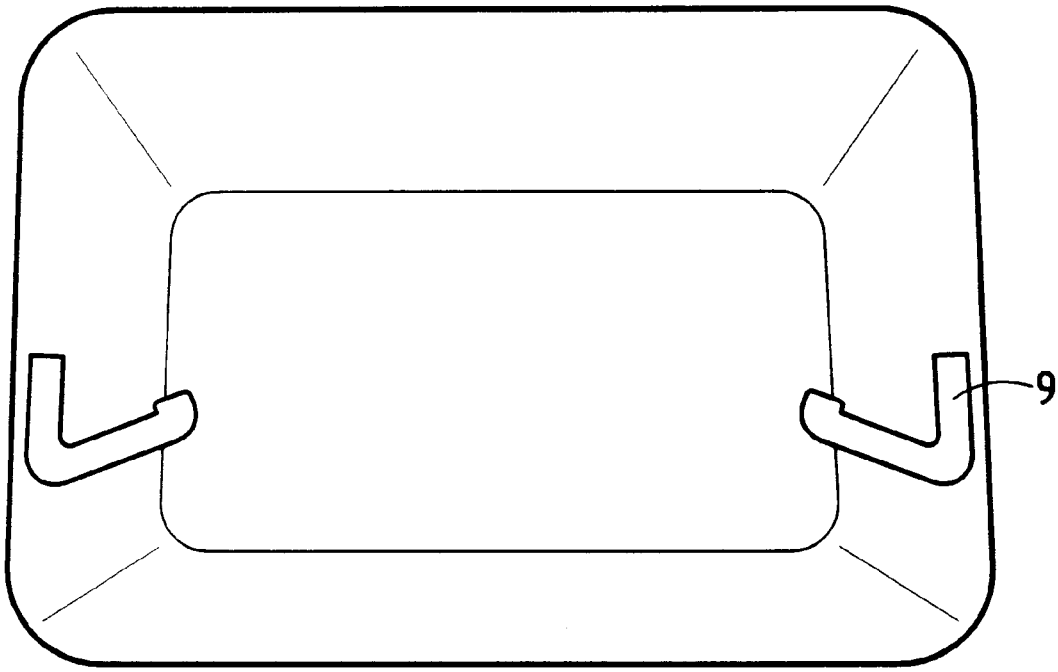
FIG. 6 shows a plan view of an example of a refuse can equipped with tongues to retain the dustpan.

FIG. 1 shows an implement according to the invention, comprising a handle 1, a refuse can 2 and a dustpan 3. As shown in the Figure, according to a particular embodiment, a brush 4 is fixed to the end of the handle 1, thus forming a broom of a width large enough to effect an efficient sweeping over large surfaces. The width of the broom is preferably greater than the largest dimension of the opening of the refuse can 2 shown fixed on the handle 1 of the broom above said brush in order for the operator to have an efficient broom and can at any moment to control the movements and the efficiency of its sweeping.

Thus, according to a preferred embodiment of the invention, the implement is a broom-dustpan-refuse can comprising a broom, on which is reversibly fixed a refuse can 2 and/or a dustpan 3.

It is particularly visible in FIG. 1 that the implement according to the invention combines all the elements necessary for the different sweeping operations.

The implement according to the invention advantageously comprises, at the end opposite that of the brush 4, an endpiece 5 for hooking, fixed on the handle. This endpiece makes it possible to store the implement according to the invention by suspending it from a nail in a stowing room and thus considerably reduce the space requirement.

The implement according to the invention requires only one stowing place for the three elements which compose it, this makes it possible for the implement to be available at any instant with all of the three elements necessary for sweeping, and therefore available for rapid use. This need for rapid intervention is particularly important in public places, such as in particular in supermarkets, in order to limit damage and especially the risks of accidents. Furthermore, the implement according to the invention considerably reduces the space requirement for a broom, a dustpan and a refuse can, taken separately.

The term "refuse can" is defined as any recipient, whatever its shape or dimension, capable of collecting the elements gathered with the aid of the broom, namely dust and/or small-dimensioned refuse.

According to a preferred embodiment, the implement according to the invention present the particularity of bringing together the refuse can 2 and the dustpan 3 at the same time on its handle 1. In effect, the refuse can 2 and the dustpan 3 may both be provided with the reversible fixing means 6 and be reversibly fixed on the handle of the implement.

According to another preferred embodiment of the invention, the dustpan is fixed on the handle by means of a clip, and further comprises notches 8 which retain it, in a reversible manner, on the refuse can. These notches are made on the oblique edge of the dustpan and their function is to lock the dustpan 3 on the refuse can 2.

The fixing means may be clips 7, or collars or rings 6. Of course, the refuse can and the dustpan may both be fixed to the handle by clips 7, but it is also possible that the dustpan be fixed to the handle by a clip and that the refuse can be fixed to the handle by another fixing means, such as in particular a collar or a ring 6.

A device wherein the means for fixing the dustpan and the refuse can are located on the handle of the implement, must be considered as a device equivalent to that of the invention.

The fixing means according to the invention, whether it be clips 7, collars or rings 6, or of any other appropriate means, are such that they allow the refuse can and/or the dustpan to slide along the sleeve and be locked at a determined height without the dustpan resting or abutting on the upper part of the brush 4. In this way, the height that which the refuse can and/or the dustpan is located is adjustable by the operator as a function of his/her size, and the weight represented by the refuse can and/or the dustpan will thus not be detrimental to the facility nor the quality of sweeping.

According to another preferred embodiment of the invention, the refuse can 2 has a capacity of one to two liters. This capacity has been chosen because it makes it possible to place on the broom a refuse can 2 whose space requirement is small and also makes it possible to sweep more than 200 $m^2$ of surface. Furthermore, one of the characteristics of the implement according to the invention is that it is constituted by particularly light materials.

According to another preferred embodiment of the invention, the refuse can comprises means for evacuating its contents, such as a door, a slideway or a valve or any appropriate means (not shown). Preferably, these means make it possible not to have to tip the refuse can completely in order to avoid undesirable clouds of dust.

According to another preferred embodiment of the invention, the refuse can contains tongues 9 capable of reversibly locking to a dustpan. In that case, it is quite possible for the dustpan 3 not to be provided with fixing means. The refuse can 2 may be made of any appropriate material, but, for obvious reasons of cost, it will most often be made of plastic or polymer resin. In that case, according to the preferred embodiment, the tongues are also made of plastic or polymer resin and are made at the same time as the refuse can is moulded.

These tongues are preferably two in number.

According to another embodiment of the invention, the tongues 9 are either inside the refuse can, which is preferred, or outside the refuse can.

These tongues 9 are preferably located at the level of the upper half of the refuse can 2, and the dustpan 3 does not touch the bottom of the refuse can.

According to another embodiment of the invention, the refuse can 2 is composed of a belt 10 and a box 11. The belt is provided with the fixing means 6 or 7 and is intended to be fixed on the handle 1 of the implement Its second function is to retain a box 11 intended to receive the refuse or dust. This embodiment is particularly practical, since it makes it possible to empty the box 11 rapidly and simply, and necessitates few manipulations. The diameter of the lower part of the belt 10 is slightly smaller than the diameter of the middle of the box 11, so that the box 11 is retained in vertical position in its middle without being wedged in the belt 10.

The use of the implement according to the invention is recommended for cleaning floors and/or stairs. It is particularly practical for cleaning spiral staircases. In effect, the implement according to the invention makes it possible to avoid piling up the dust, and therefore to reduce their dispersion or scattering by draughts or by third persons inadvertently passing by. As indicated in the preamble, it also makes it possible to avoid the operator climbing the stairs to pick up the dustpan and the refuse can placed on the floor in order to terminate the sweeping phase, hence a saving of time, fatigue, and serious physical accident s due to people falling on the stairs by tripping over the dustpan and the refuse can placed on the floor.

Another advantage of the invention is to reduce by 30% the number of times that the operator must bend down: this saving of efforts allows his/her fatigue during the operation to be considerably reduced.

The invention claimed is:

1. An implement comprising:

(a) a broom having a brush and a handle attached to the brush;

(b) a refuse can;

(c) first means for detachably mounting said refuse can on the broom handle at a determined height above the brush;

(d) a dustpan comprising second means for detachably mounting the dustpan on the broom handle such that the dustpan is detachable from the broom handle independently of the refuse can.

2. An implement according to claim 1, wherein the first means comprises a collar or ring.

3. An implement according to claim 1, wherein said second means comprises a clip.

4. An implement according to claim 1, wherein said refuse can comprises a box and said first means comprises belt means for mounting the box on the handle in a vertical disposition.

5. An implement according to claim 1, wherein the refuse can has a capacity of one to five liters.

6. An implement according to claim 1, wherein the refuse can comprises means for evacuating contents of the refuse can.

7. An implement according to claim 1, wherein the refuse can contains tongue means for reversibly attaching the dustpan to the refuse can with each of the dustpan and refuse can mounted on the broom handle.

8. An implement according to claim 1, wherein the dustpan comprises notch means for retaining the dustpan reversibly attached to the refuse can with each of the dustpan and refuse can mounted on the broom handle.

9. A method for sweeping a floor or stair comprising:

(a) providing the implement of claim 1 with each of the dustpan and refuse can mounted on the broom handle;

(b) sweeping dust on the floor or stair into a pile with the broom;

(c) detaching the dustpan from the broom handle and sweeping the pile into the dustpan with the broom; and (d) emptying the pile from the dustpan into the refuse can.

* * * * *